United States Patent [19]

Stoecker

[11] Patent Number: 4,680,904

[45] Date of Patent: Jul. 21, 1987

[54] MOBILE HOME SKIRTING SYSTEM

[76] Inventor: Don R. Stoecker, Georgetown Lake, Anaconda, Mont. 59711

[21] Appl. No.: 931,354

[22] Filed: Nov. 17, 1986

[51] Int. Cl.[4] ..... B60R 27/00; E02D 27/00

[52] U.S. Cl. ..... 52/169.12; 52/DIG. 3; 52/126.3

[58] Field of Search ..... 52/DIG. 3, 169.12, 645, 52/126.3; 280/768

[56] References Cited

U.S. PATENT DOCUMENTS

| | | | |
|---|---|---|---|
| 2,961,255 | 11/1960 | Trott | 52/169.12 |
| 3,256,655 | 6/1966 | Teeter . | |
| 3,313,081 | 4/1967 | Squire | 52/645 |
| 3,589,085 | 6/1971 | Sickler | 52/126.3 |
| 3,785,675 | 1/1974 | Norris | 52/DIG. 3 |
| 4,038,800 | 8/1977 | Daley | 52/645 |
| 4,112,638 | 9/1978 | Hanson, Sr. . | |
| 4,352,261 | 10/1982 | Wargo . | |
| 4,407,101 | 10/1983 | Propst | 52/126.3 |
| 4,549,378 | 10/1985 | Ayers et al. . | |
| 4,612,848 | 9/1986 | Pollack | 52/645 |

*Primary Examiner*—John E. Murtagh

*Attorney, Agent, or Firm*—Henderson & Sturm

[57] ABSTRACT

A framework for extending around the lower periphery of a trailer house of mobile home, including corner posts and intermediate posts which are adjustable in length. Upper, lower and intermediate links interconnect the upstanding corner posts with the intermediate posts to form a framework. Canvas, plywood, sheet metal or other coverings are then connected to the framework to seal the area below the trailer house from the outside atmosphere.

5 Claims, 12 Drawing Figures

MOBILE HOME SKIRTING SYSTEM

TECHNICAL FIELD

The present invention relates generally to a mobile home skirting system and more particularly to such a system which is portable and easily assembled and disassembled when the mobile home is moved from place to place.

BACKGROUND ART

Skirting systems have been used for many years around mobile homes or trailer houses for the purpose of insulating the trailer from outside temperature changes and also for improving the appearance of the mobile home or trailer house. Certain of these structures such as that shown in U.S. Pat. No. 4,352,261 to Wargo and U.S. Pat. No. 4,549,378 to Ayers et al., tend to be more or less of a permanent configuration used in situations where the mobile home or trailer house is not moved very often. A problem is that these types of structures are not very suitable for the situation where a trailer house is moved quite often, such as when a construction site moves from place to place or when the owner tends to move a mobile home from place to place fairly often.

U.S. Pat. Nos. 3,256,655 to Teeter and 4,112,638 to Hanson tend to be somewhat more portable than the aforementioned structures, but still have certain shortcomings.

DISCLOSURE OF THE INVENTION

The present invention relates generally to a trailer skirting apparatus including a corner post disposed under each exterior corner of the mobile home, each of the corner posts including a main housing having four planar sides, a first side having a pair of openings therein spaced apart by a predetermined distance, and a second side, perpendicular to the first side. The second side also has a pair of openings spaced apart by such predetermined distance. A base member is adapted to contact the ground and has a threaded member threadably engaging a bottom portion of the main housing and a top portion of the base member. The threaded member has right hand external threads on one end and left hand external threads on the other end and a central structure thereon for selectively rotating the threaded member to selectively lengthen or shorten the effective distance between the main housing and the base member. Square tubular extension members extend from the first and second sides of the base member.

Intermediate posts are disposed between each of the corner posts and are in most respects very similar to the corner post structure. Top, bottom and intermediate horizontally disposed links are provided for interconnecting the corner posts with the intermediate posts. A covering is provided for extending around the entire lower portion of the mobile home and structures provided for selectively attaching or detaching the top and bottom of the covering to the top and bottom horizontally disposed lengths.

An object of the present invention is to provide an improved portable trailer skirting apparatus.

Another object of the present invention is to provide a trailer skirting apparatus which is easily installed or disassembled and reinstalled for use at a different location.

A further object of the present invention is to provide a trailer skirting apparatus which uses various types of coverings, such as canvas, wood or sheet metal.

Other objects, advantages, and novel features of the present invention will become apparent from the following detailed description of the invention when considered in conjunction with the accompanying drawings.

BEST MODE FOR CARRYING OUT THE INVENTION

Figure 1:
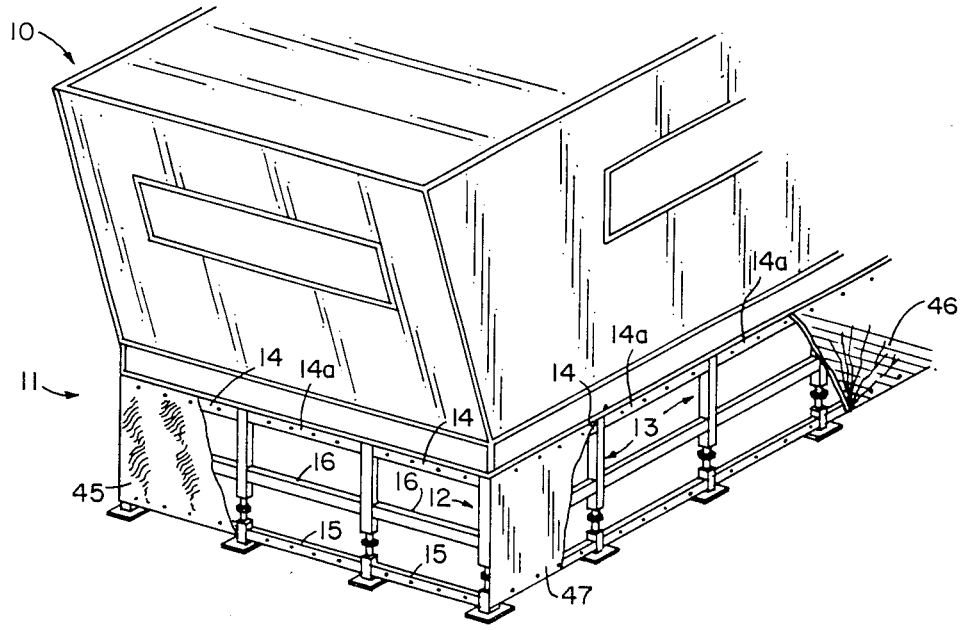
FIG. 1 is a perspective view of a trailer house having the present invention installed thereon, with portions of the covering broken away for clarity.

Referring now to the drawings, wherein like reference numerals designate identical or corresponding parts throughout the several views, FIG. 1 shows a trailer house (10) having a portable trailer skirting apparatus attached around the lower periphery thereof.

Figure 2:
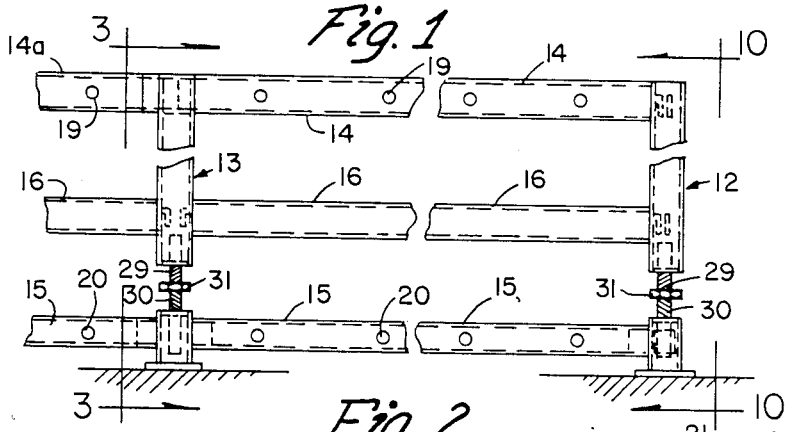
FIG. 2 is a front view of the frame of the trailer skirting apparatus.
Figure 3:
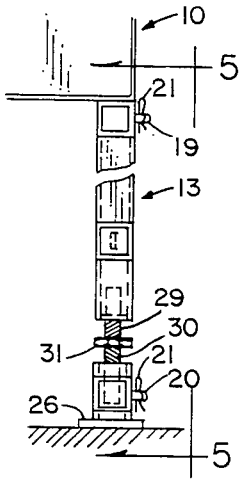
FIG. 3 is a cross sectional view taken along line 3—3 of FIG. 2.
Figure 5:
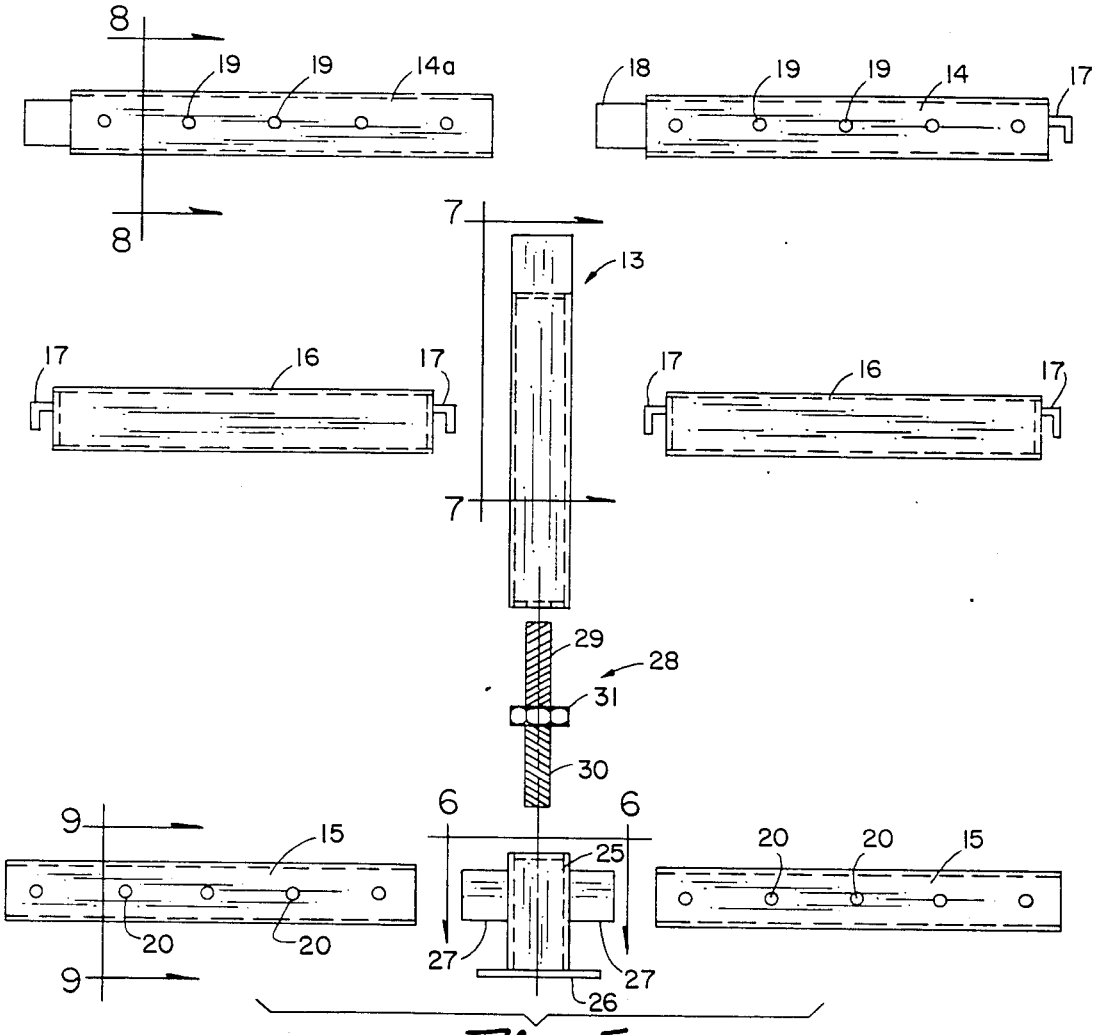
FIG. 5 is a side elevational exploded view of the structure shown in FIG. 4.
Figure 8:
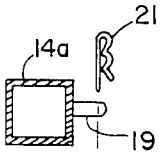
FIG. 8 is a cross sectional view taken along line 8—8 of FIG. 5.
Figure 7:
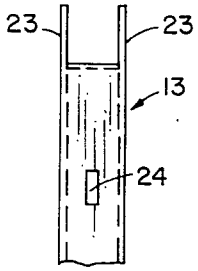
FIG. 7 is a view taken along line 7—7 of FIG. 5.
Figure 6:
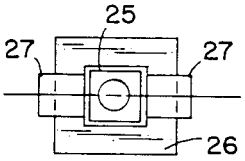
FIG. 6 is a view taken along line 6—6 of FIG. 5.
Figure 9:
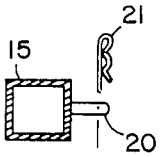
FIG. 9 is a cross sectional view taken along line 9—9 of FIG. 5.

The framework of the portable trailer skirting apparatus (11) includes corner post structures (12) and intermediate post structures (13). Top horizontally disposed links (14), bottom horizontally disposed links (15) and intermediate horizontally disposed links (16) are used to interconnect the corner post (12) and the intermediate post (13), for example as shown in FIG. 2. The top links (14) have hooks (17) on one end thereof and a tubular projection (18) on the other end thereof. The hooks (17) are identical to the hooks (17) on intermediate links (16). A plurality of evenly spaced apart pins (19) are rigidly attached to the upper or top links (14 and **14*a*) and similar pins (20) are evenly spaced and rigidly attached to the bottom links (15) as can readily be seen in FIGS. 5 and 9. Locking keys (21) are provided for extending through the opening in either the pins (19 or 20**).

Figure 4:
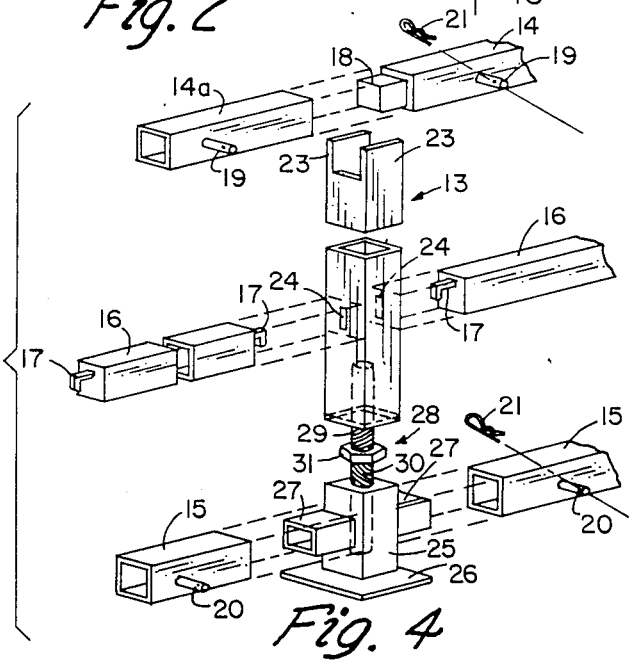
FIG. 4 is an exploded perspective view of one of the intermediate posts and the links that interconnect thereto.

Referring now to FIG. 4, it is noted that the intermediate post (13) has upper flanges (23) disposed thereon for receiving the top links (14) therein when the projection (18) of link (14) is telescoped into the open end of link (**14*a*). Holes (24) in the side of the intermediate post (13) are for receiving the hooks (17) of intermediate horizontally disposed link (16). A base housing (25) having a ground engaging plate (26) welded to the bottom thereof also has a pair of flanges (27) extending in opposite directions therefrom for sliding into the open ends of the bottom links (15**) for holding the bottom links (15) in place and also for preventing them from turning around their longitudinal axis. An extension rod (28) has right hand threads (29) on an upper portion thereof and left hand threads on a lower portion thereof for internally mating with threads on the lower end of a plate in the post (13) and on the upper end of the base member (25). A hex-shaped flange (31) is provided so that when a wrench is attached to the portion (31) and turned in one direction, the intermediate post (13) will move upwardly and when the flange (31) is rotated in the other direction, the intermediate post (13) will move downwardly with respect to the base member (25). Consequently, the height of the post (13) can easily be adjusted to conform to irregularities in the ground and also to different heights of trailer houses or mobile homes.

Figure 11:
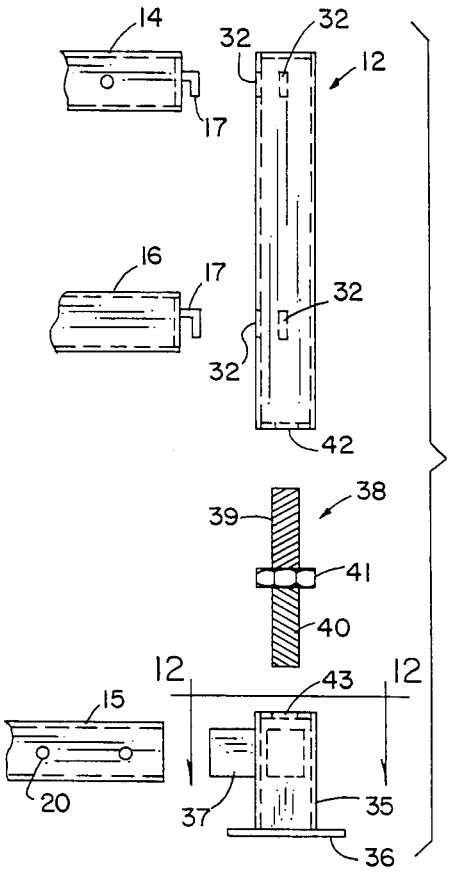
FIG. 11 is a view taken along line 11—11 of FIG. 10.
Figure 10:
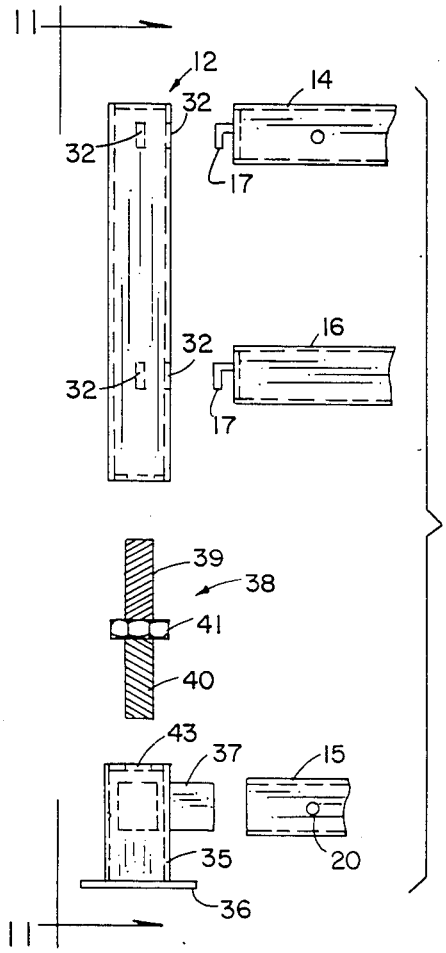
FIG. 10 is a side elevational exploded view of one of the corner post sections.
Figure 12:
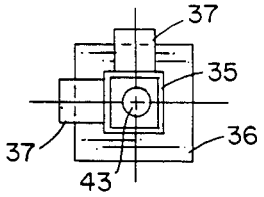
FIG. 12 is a view taken along line 12—12 of FIG. 11.

Referring now to FIGS. 10–12, it is noted that the corner post (12) have a plurality of openings (32) therein for receiving the hooks (17) on links (14 and 16). These corner posts (12) include a base member (35) having a lower plate (36) welded thereto for contact with the ground. Square tubular extension members (37) are welded to the base member (35) and telescope into the openings in bottom links (15).

A threaded member (38) has upper right hand threads (39) and lower left hand threads (40) and an intermediate hex-shaped flange (41). Consequently, just as in the FIG. 4 embodiment of the intermediate post, the corner post (12) can be moved extended to be longer or shortened by rotating the threaded member (38) in one direction or the other by attaching a wrench to the hex flange (41). It is noted that the opening (42) in the lower end of corner post (12) is threaded to in a right hand thread and to correspond to the threads on (39) and the openings (43) in the base member (35) are threaded in an opposite direction in order to accept the threads on lower portion (40) of the threaded member (38).

The framework is set up, for example as shown in FIG. 1, by interconnecting the vertical corner post with the vertical intermediate post and having the top, bottom and intermediate horizontally disposed links interconnected thereto. Also, each of the base members is adjusted to provide the proper height of the corner or intermediate post. Once that has been done, then canvas (45) having grommets spaced to be received over each one of the upper and lower pegs (19 and 20) are utilized. Once the canvas is stretched over the pegs (19 and 20), then the pins (21) are inserted through the openings in (19 and 20), for example as shown in FIGS. 3, 4, 8 and 9. These pins (21) will prevent the canvas from falling off of the pegs (19 and 20). The canvas (45) is then stretched completely around the framework, to completely enclose the lower portion below the trailer house (10).

In an alternate embodiment of the present invention, plywood (46) can be utilized to either go directly over the pins (19 and 20), or other types of fasteners, such as fasteners for storm windows or screens can be utilized to hold the plywood (46) in shape. Still another type of structure which can be used instead of the canvas (45) is sheet metal (47). Similarly, either the pegs (19 and 20) can be utilized, or other types of fasteners can attach the sheet metal to upper links (14 and 14*a*) and lower links (15). Although FIG. 1 shows canvas (45), plywood (46) and sheet metal (47, it is to be understood that only one of these three is used at any one time, and whatever is chosen goes all the way around the mobile home.

Accordingly, it will be appreciated that the preferred embodiment disclosed herein does indeed accomplish the aforementioned objects. Obviously, many modifications and variations of the present invention are possible in light of the above teachings. It is therefore to be understood that, within the scope of the claims, the invention may be practised otherwise than as specifically described.

I claim:

1. Apparatus for enclosing the underside of a mobile home comprising:

a corner post disposed under each exterior corner of said mobile home, each of said corner posts comprising a main housing having four planar sides, a first side having a pair of openings therein spaced apart by a predetermined distance and a second side, perpendicular to said first side, said second side also having a pair of openings spaced apart by said predetermined distance and a base member adapted to contact the ground, a threaded member threadably engaging a bottom portion of said main housing and a top portion of said base member, said threaded member having right-hand external threads on one end thereof and left-hand external threads on the other end thereof and central means thereon for selectively rotating said threaded member to selectively lengthen or shorten the effective distance between said main housing and said base member, and square tubular extension means extending from first and second sides of said base member thereof;

an intermediate post disposed between each of said corner posts, each of said intermediate posts comprising an elongated housing having the top end in abutment with a bottom portion of said mobile home, a base housing adapted to contact the ground and an extension rod threadably engaged on the top thereof with the bottom of said elongated housing and the bottom thereof threadably engaged with the top of said base housing, one end of said extension rod having right hand external threads thereon and the other end having left hand external threads thereon and means attached to said extension rod for rotating said extension rod to selectively shorten or lengthen the effective distance between said elongated housing and said base housing, said elongated housing having a pair of spaced holes therein on each of a first and a second side thereof, said first and second sides of said elongated housing being parallel to each other, and said base housing having a square tubular extension means extending from each of first and second parallel sides thereof, said square tubular extension means being aligned with each other and having a common longitudinal axis;

top horizontally disposed link means for interconnecting adjacent corner posts and intermediate posts, the end of said top horizontally disposed link means having extensions thereon for extending into said openings in said main housings of said corner posts and holes in said elongated housing in said intermediate posts;

bottom horizontally disposed link means for interconnecting with adjacent base members of said corner posts and base housings of said intermediate posts, said bottom horizontally disposed link means being telescopically connected on the ends thereof to the square tubular extensions on said base members of said corner posts and said base housing of said intermediate posts;

intermediate horizontally disposed link means for interconnecting with adjacent main housings of said corner posts and elongated housing of said intermediate posts, said intermediate horizontally disposed link means having extensions thereon for selectively extending into said openings in said main housing of said corner posts and said holes in the elongated housing in said intermediate posts, said intermediate horizontally disposed link means being below said top horizontally disposed link means and below said bottom horizontally disposed link means;

a covering for extending around the entire mobile home;

means for selectively attaching or detaching the top of said covering to said top horizontally disposed link means; and means for selectively attaching or detaching said covering to the bottom horizontally disposed link means whereby the mobile home can be sealed thereunder from outside air.

2. The apparatus of claim 1 wherein said covering is a flexible material.

3. The apparatus of claim 2 wherein said flexible material is canvas.

4. The apparatus of claim 1 wherein said covering is wood.

5. The apparatus of claim 1 wherein said covering is sheet metal.

* * * * *